US010852652B2

(12) United States Patent
Yamashita et al.

(10) Patent No.: US 10,852,652 B2
(45) Date of Patent: Dec. 1, 2020

(54) TONER

(71) Applicant: CANON KABUSHIKI KAISHA, Tokyo (JP)

(72) Inventors: Daisuke Yamashita, Matsudo (JP); Masaharu Miura, Toride (JP); Takaho Shibata, Tokyo (JP); Wakiko Katsumata, Kashiwa (JP); Yuichi Mizo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/537,410

(22) Filed: Aug. 9, 2019

(65) Prior Publication Data

US 2020/0057398 A1 Feb. 20, 2020

(30) Foreign Application Priority Data

Aug. 14, 2018 (JP) ..... 2018-152731
Jul. 10, 2019 (JP) ..... 2019-128587

(51) Int. Cl.

| | |
|---|---|
| ***G03G 9/08*** | (2006.01) |
| ***G03G 9/09*** | (2006.01) |
| ***G03G 9/087*** | (2006.01) |

(52) U.S. Cl.

CPC ..... *G03G 9/0902* (2013.01); *G03G 9/0819* (2013.01); *G03G 9/0821* (2013.01); *G03G 9/0823* (2013.01); *G03G 9/08755* (2013.01); *G03G 9/0904* (2013.01)

(58) Field of Classification Search

CPC ..... G03G 9/0821; G03G 9/0823
USPC ..... 430/111.41, 111.4
See application file for complete search history.

(56) References Cited

FOREIGN PATENT DOCUMENTS

| | | | |
|---|---|---|---|
| JP | H04-316056 | A | 11/1992 |
| JP | 2011-6622 | A | 1/2011 |
| JP | 2016-128885 | A | 7/2016 |

*Primary Examiner* — Mark A Chapman
(74) *Attorney, Agent, or Firm* — Canon U.S.A., Inc. IP Division

(57) ABSTRACT

A toner containing a toner particle, in which the toner particle contains a binder resin and a pigment, and As and Al satisfy a specific relation, in a case when the toner is divided into two groups i.e. a first group and a second group with an inertial classifier, the first group including a larger size of the toner particles, and the second group including a smaller size of the toner particles, and the number of the toner particles in the first group being substantially equal to the number of the toner particles in the second group. Each of As and Al is a change rate of a surface potential of a pellet type molded product obtained by molding each of the toner in the first group and the toner in the second group under specific conditions is observed using a surface potentiometer under a specific conditions.

5 Claims, 1 Drawing Sheet

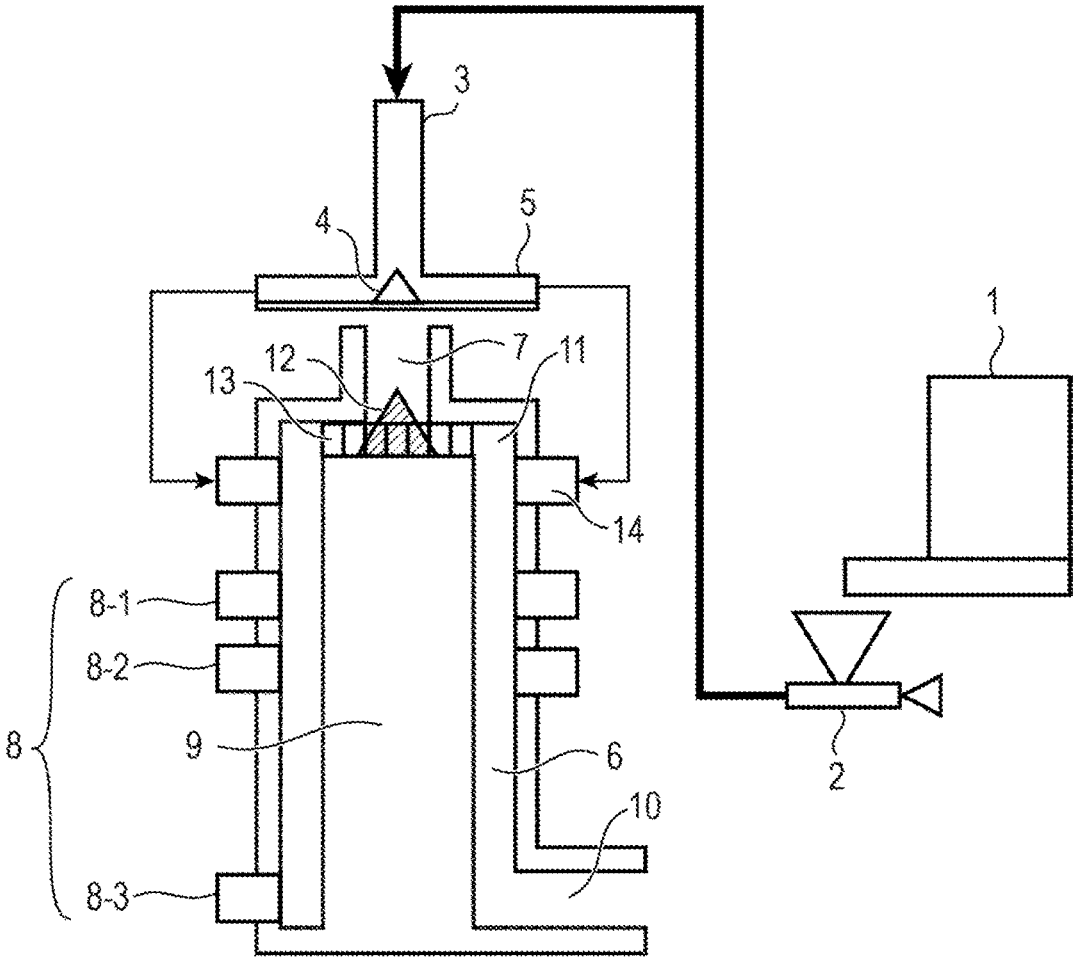
3
4
5
1
12
7
11
13
14
8-1
8-2
8
9
6
10
8-3
2

TONER

BACKGROUND OF THE INVENTION

Field of the Invention

The present disclosure relates to a toner used in an electrophotographic method, an electrostatic recording method, an electrostatic printing method, and the like.

Description of the Related Art

In recent years, in accordance with the widespread of electrophotographic copying machines, the demand for high image quality and stabilization of an image density has been required.

For high image quality, specifically, in order to improve dot reproducibility, a toner having a small particle diameter has been required. Accordingly, a toner having a small particle diameter and a sharp particle size distribution has been proposed (Japanese Patent Application Laid-Open No. 2016-128885).

Furthermore, in order to improve color stability of a black toner, which is important from the viewpoint of forming fine lines or characters, a toner in which two kinds of black pigments are used has been proposed (Japanese Patent Application Laid-Open No. 2011-6622).

In addition, for stabilization of an image density, a toner of which charge quantity is not too large even in a low humidity environment has been required. Accordingly, an externally designed toner to make charge quantity not too large even in a low humidity environment has been proposed (Japanese Patent Application Laid-Open No. H04-316056).

In the toners disclosed in Japanese Patent Application Laid-Open No. 2016-128885, Japanese Patent Application Laid-Open No. 2011-6622, and Japanese Patent Application Laid-Open No. H04-316056, each particle of the toner has a uniform coverage rate of a shell layer and inorganic fine particles, and a surface charge density is constant regardless of a particle diameter. That is, the smaller the particle diameter is, the smaller the surface area is, so, the smaller the particle diameter of a toner is, the smaller the charge quantity per particle of the toner is.

A small particle diameter toner having small charge quantity is poor in terms of the followability to an electric field. As a result, in some cases, in a step of transferring of the electrophotographic method, when transferring is performed by using the electric field from an electrostatic latent image-bearing member to an intermediate transferring member or media, transferability of the toner deteriorates.

In addition, in an alternating current (AC) developing system, in some cases, since a force for separating a toner from an electrostatic latent image-bearing member by a pullback bias is weak, the toner remains with attached to the electrostatic latent image-bearing member, and fogging occurs.

Meanwhile, when the amount of inorganic fine particles added is increased in order to make charge quantity per particle of the toner large, the charge quantity per unit weight becomes too large. Therefore, an electrostatic latent image is embedded due to a small amount of toner and the image density deteriorates, such that the image density stability may deteriorate.

SUMMARY OF THE INVENTION

One aspect of the present disclosure is directed to providing a toner excellent in image quality, transferability, and image density stability, and suppressing fogging.

According to one aspect of the present disclosure, there is provided a toner containing a toner particle, in which the toner particle contains a binder resin and a pigment. Then, when the toner is divided into two groups i.e. a first group and a second group with an inertial classifier, the first group including a larger size of the toner particles, and the second group including a smaller size of the toner particles, and the number of the toner particles in the first group being substantially equal to the number of the toner particles in the second group, Al and As satisfy the following Expression (1).

$$1.5 \leq Al/As \leq 2.5 \quad (1)$$

wherein Al represents a change rate (%) of a surface potential of a pellet type molded product Pl made of the toner in the first group as measured by a following procedure:

measurement of Al:

molding 0.05 g of the toner in the first group under conditions of 20 kN to form the pellet type molded product Pl having a diameter of 10 mm;

charging a surface of the pellet type molded product Pl to −600 V by a scorotron charger; after the charging, measuring a surface potential of the pellet type molded product Pl to obtain an initial surface potential;

after the obtaining of the initial surface potential, leaving the pellet type molded product Pl under conditions of a temperature of 25° C. and a humidity of 50% for 1 hour; after the leaving, measuring the surface potential of the pellet type molded product Pl and calculating a changing rate of the surface potential with respect to the initial surface potential as the change rate (%), and As represents a change rate (%) of a surface potential of a pellet type molded product Ps made of the toner in the second group as measured by a following procedure:

measurement of As:

molding 0.05 g of the toner in the second group under conditions of 20 kN to form the pellet type molded product Ps having a diameter of 10 mm;

charging a surface of the pellet type molded product Ps to −600 V by a scorotron charger; after the charging, measuring a surface potential of the pellet type molded product Ps to obtain an initial surface potential;

after the obtaining of the initial surface potential, leaving the pellet type molded product Ps under conditions of a temperature of 25° C. and a humidity of 50% for 1 hour;

after the leaving, measuring the surface potential of the pellet type molded product Ps and calculating the changing rate of the surface potential with respect to the initial surface potential as the change rate (%).

Further features of the present disclosure will become apparent from the following description of exemplary embodiments with reference to the attached drawing.

BRIEF DESCRIPTION OF THE DRAWINGS

FIG. 1*s* a view of a heat spheroidizing treatment apparatus used in production of a toner.

DESCRIPTION OF THE EMBODIMENTS

In the present disclosure, the description "○○ or more and xx or less" or "○○ to xx" representing a numerical range refers to a numerical range including a lower limit and an upper limit which are endpoints, unless otherwise stated.

In the conventional technologies described above, there is a trade-off relation between improvement of image density stability and transferability and suppression of fogging, and there is room for improvement in image quality, image density stability, transferability, and suppression of fogging.

The present inventors conducted studies of a toner excellent in image quality, transferability, and image density stability and suppressing fogging. In the course of the studies, the present inventors found that a main cause of deterioration of transferability, occurrence of fogging, and deterioration of image density stability is a difference in charge quantity between toner particles having different diameters.

Specifically, the main cause of deterioration of transferability and occurrence of fogging is due to fine particles of a toner having a small charge quantity per particle of the toner. Meanwhile, deterioration of image density stability is caused by a large charge quantity of coarse particles of a toner having a large mass per particle. Therefore, the present inventors found that the trade-off can be eliminated when taking measures against the problems for each particle diameter.

The toner according to the present disclosure is a toner containing a toner particle, in which the toner particle contains a binder resin and a pigment. Then, when the toner is divided (classified) into two groups i.e. a first group and a second group with an inertial classifier, the first group including a larger size of the toner particles, and the second group including a smaller size of the toner particles, and the number of the toner particles in the first group being substantially equal to the number of the toner particles in the second group, Al and As satisfy the following Expression (1).

$$1.5 \leq Al/As \leq 2.5 \quad (1)$$

wherein Al represents a change rate (%) of a surface potential of a pellet type molded product Pl made of the toner in the first group as measured by a following procedure:

measurement of Al:

molding 0.05 g of the toner in the first group under conditions of 20 kN to form the pellet type molded product Pl having a diameter of 10 mm;

charging a surface of the pellet type molded product Pl to −600 V by a scorotron charger; after the charging, measuring a surface potential of the pellet type molded product Pl to obtain an initial surface potential;

after the obtaining of the initial surface potential, leaving the pellet type molded product Pl under conditions of a temperature of 25° C. and a humidity of 50% for 1 hour; after the leaving, measuring the surface potential of the pellet type molded product Pl and calculating a changing rate of the surface potential with respect to the initial surface potential as the change rate (%), and As represents a change rate (%) of a surface potential of a pellet type molded product Ps made of the toner in the second group as measured by a following procedure:

measurement of As:

molding 0.05 g of the toner in the second group under conditions of 20 kN to form the pellet type molded product Ps having a diameter of 10 mm;

charging a surface of the pellet type molded product Pl to −600 V by a scorotron charger; after the charging, measuring a surface potential of the pellet type molded product Ps to obtain an initial surface potential;

after the obtaining of the initial surface potential, leaving the pellet type molded product Ps under conditions of a temperature of 25° C. and a humidity of 50% for 1 hour; after the leaving, measuring the surface potential of the pellet type molded product Ps and calculating the changing rate of the surface potential with respect to the initial surface potential as the change rate (%).

Note that the change rate is a value represented by $$\text{Change rate } (\%) = (V_0 - V)/V_0 \times 100,$$

in a case where an absolute value of an initial surface potential is $V_0$ and an absolute value of a surface potential after 1 hour is V.

The method for dividing the toner into the first group containing a larger size of the toner particles and the second group containing a smaller size of the toner particles will be described later.

Both the first group and the second have a distribution with respect to the particle size. The first group and the second group have a relation that a median diameter of the toner in the first group is larger than a median diameter of the toner in the second group. It should be noted that the first group and the second group do not have a relation that a smallest particle in the first group is larger than the largest particle in the second group. When the toner particles are divided substantially equally in half to an extent that the difference between particle numbers of the first group and the second group is 4% or less, and the respective groups of toner particles meet the requirements defined in the present disclosure, satisfactory effects may be obtained. Thus, the toner particles being "divided substantially equally in half" described herein means the toner particles being divided substantially equally in half to an extent that the particle number difference is 4% or less.

It is considered that each of As and Al which is the change rate of the charge quantity of the pellet type molded product surface in 1 hour indicates the ease of diffusion of charges present in the vicinity of a toner surface into the inside of the toner.

When Expression (1) is satisfied, it is considered that charge retention of the second group is higher than that of the first group. Therefore, a surface charge density of the toner on the small particle diameter side after triboelectric charge becomes higher than that of the toner on the larger particle diameter side, and the charge quantity per particle of the toner on the small diameter particle side becomes large. Accordingly, it is possible to suppress deterioration of transferability and occurrence of fogging caused due to a small charge quantity of the toner on the small particle diameter side.

Furthermore, since the toner satisfies Expression (1), such that the charge quantity per particle of the toner on the small diameter particle side becomes large, it is not necessary to take measures to make the charge quantity per particle of the toner large regardless of a particle diameter by increasing the amount of inorganic fine particles added. That is, it is possible to improve image density stability without making the charge quantity of the toner on the large particle diameter side, which is the cause of the large charge quantity per unit mass of the toner, too large.

Note that the change rate As is preferably 40% or less from the viewpoint of charge retention. Further, the change rate Al is preferably 50 to 80% in terms of a particularly preferable balance between the charge quantity and the charge retention.

As a method of increasing a surface charge change rate of the first group more than that of the second group, the following methods may be mentioned by way of example. For example, an example of the methods includes a method of changing the addition amount of charge control agent imparting charge retention in a first group and a second group or a method of changing a content of each pigment for each particle diameter by using two kinds of pigments.

By containing a large content of the charge control agent in the second group, the surface charge change rate of the first group can be relatively increased. The known charge control agent can be used. In particular, a charge control agent which has a high charging speed and can stably maintain a certain charge quantity is preferable.

Examples of the charge control agent for controlling toner particles to be negatively chargeable include as follows.

Examples of an organometallic compound and a chelate compound include a monoazo metal compound, an acetylacetone metal compound, metal compounds of an aromatic oxycarboxylic acid, an aromatic dicarboxylic acid, an oxycarboxylic acid, and a dicarboxylic acid. In addition, the examples thereof also include an aromatic oxycarboxylic acid, aromatic monocarboxylic and polycarboxylic acids, and a metal salt thereof, an anhydride and esters, and phenol derivatives such as bisphenol. Furthermore, the examples thereof include a urea derivative, a metal-containing salicylic acid-based compound, a metal-containing naphthoic acid-based compound, a boron compound, a quaternary ammonium salt, and a calixarene.

Meanwhile, examples of the charge control agent for controlling the toner particles to be positively chargeable can include nigrosin and a nigrosin modified product by a fatty acid metal salt; a guanidine compound; an imidazole compound; quaternary ammonium salts such as a tributylbenzylammonium-1-hydroxy-4-naphthosulfonic acid salt and tetrabutylammonium tetrafluoroborate, and onium salts such as a phosphonium salt as analogs thereof and a lake pigment thereof; a triphenylmethane dye and a lake pigment thereof (examples of a lake agent including a phosphotungstic acid, a phosphomolybdic acid, a phosphotungstomolybdic acid, a tannic acid, a lauric acid, a gallic acid, ferricyanide, and ferrocyanide); a metal salt of a higher fatty acid; and a resin-based charge control agent.

In a case where a content of two kinds of pigments is changed for each particle diameter, by using two kinds of pigments having different resistances, the first group contains more of a low-resistance pigment and the second group contains more of a high-resistance pigment. Therefore, from the difference in a surface resistivity between the first group and the second group, the surface charge change rate of the first group can be relatively increased.

The use of two kinds of pigments is preferable from the viewpoint of easily exhibiting a good black color due to a wide absorption wavelength range of visible light in a black toner.

A resistance of a black pigment can be evaluated by forming a film of a resin dispersion obtained by dispersing the black pigment which is a measurement sample into a general purpose resin such as polyethylene, acryl, and polyester, and measuring a surface resistivity of a resin-pigment film with a surface resistance meter.

In the black toner, regarding a surface resistivity of a polyethylene-black pigment film formed by using a resin composition obtained by dispersing 50 parts by mass of the black pigment in 50 parts by mass of polyethylene, it is preferable that a high-resistance black pigment having a surface resistivity of $1\times10^{13}$ Ω/cm$^2$ or more and a low-resistance black pigment having a surface resistivity of $1\times10^{11}$ Ω/cm$^2$ or less are contained.

Furthermore, bkh, bkl, BKH, BKL preferably satisfy the following Expression (2) to (4), $$bkl/bkh \leq 0.5 \quad (2),$$

$$BKH/BKL \leq 0.5 \quad (3), \text{ and}$$

$$0.9 \leq (bkl+bkh)/(BKH+BKL) \leq 1.1 \quad (4),$$

in which BKH is a content of the high-resistance black pigment and BKL is a content of the low-resistance black pigment in the first group, and bkh is a content of the high-resistance black pigment and bkl is a content of the low-resistance black pigment in the second group.

In a case where a specification related to the above surface resistivity is satisfied, a contrast of a resistance value of both pigments is sufficiently large. Therefore, a difference of surface charge density values of the second group and the first group does not become excessively small.

In addition, in a case where bkl/bkh≤0.5, the surface charge density of the second group is sufficiently high and the charge quantity of the second group is large, such that transferability is improved and fogging is suppressed. In a case where BKH/BKL≤0.5, the surface charge density of the first group is not too high and the charge quantity of the entire toner is large, such that deterioration of the image density can be avoided.

Furthermore, satisfying Expression (4), a content of pigment per particle of the toner is not greatly different, which is preferable from the viewpoint of color stability.

The surface resistivity is measured, for example, as follows. First, 50 parts by mass of a black pigment is mixed with 50 parts by mass of polyethlylene and the mixture is dissolved in an organic solvent such as xylene to obtain a resin-pigment solution. A film of the obtained mixed solution is formed into a thickness of 1 μm using a spin coater to produce a resin-pigment film. Note that, Suntec LD-M1920 (manufactured by Asahi Kasei Corporation.) can be used as polyethylene. The produced resin-pigment film is measured using a resistivity meter in high resistivity range Hiresta-UX MCP-HT800 (manufactured by Mitsubishi Chemical Analytech Co., Ltd.) based on JISK6911.

In terms of low cost and a wide visible light absorption range, the low-resistance black pigment is preferably carbon black. In addition, examples of the high-resistance black pigment can include titanium black or a perylene-based black pigment. In a case where carbon black is used as the low-resistance black pigment, carbon black has relatively high transmittance in a wavelength region of 600 to 780 nm in the visible light region. Therefore, the high-resistance black pigment is more preferably titanium oxynitride having a high visible light absorbency near a wavelength 600 to 780 nm from the viewpoint of color stability.

A median diameter (D50) of the toner on a number basis is preferably 3.0 μm or more and 6.0 μm or less. Further, a span value representing a particle size distribution of the toner, which is obtained by the following Equation (5), is preferably 0.7 or more and 2.0 or less.

$$\text{Span value}=(D90-D10)/D50 \quad (5)$$

(wherein D90 is a cumulative 90% particle diameter on a number basis and D10 is a cumulative 10% particle diameter on a number basis.)

When D50 is 3.0 μm or more, transferability is improved and fogging is suppressed. In addition, when D50 is 6.0 μm or less, image quality is improved. In addition, when the span value is 0.7 or more, the effects of the present disclosure are significantly exhibited. Further, when the span value is 2.0 or less, transferability is improved and fogging is suppressed.

D50 is more preferably 3.0 μm or more and 5.5 μm or less and still more preferably 3.0 μm or more and 5.0 μm or less. By doing so, dot reproducibility is improved and excellent image quality is obtained.

Note that, D50 can be measured, for example, using a particle size distribution analyzer (Coulter Multisizer III, manufactured by Beckman Coulter, Inc.) by the Coulter method.

In addition, when an absolute value of an average value of the surface charge density of the second group is as, and an absolute value of an average value of the surface charge density of the first group is σl, the toner preferably satisfies the following Expression (6).

$$0.10 \leq \sigma l/\sigma s \leq 0.75 \quad (6)$$

A surface charge density a of the toner may be measured, for example, by the following method.

First, under an environment of 23° C. and 50% RH, 0.7 g of a toner and 9.3 g of a carrier (standard carrier designated by Imaging Society of Japan) (N-01) are placed into a 50 ml plastic bottle, the mixture is shaken using a shaker (manufactured by YAYOI Co., Ltd.) at 200 rpm for 5 minutes, and the toner is subjected to triboelectric charge. Subsequently, the charge quantity per particle of the toner of each particle diameter is measured using a charge quantity distribution measuring apparatus.

The measurement can be performed by using an E-spart analyzer (manufactured by Hosokawa Micron Corporation). The E-spart analyzer is an apparatus that measures a particle diameter and charge quantity by introducing sample particles into a detection unit (measuring unit) in which both an electrical field and an acoustic field are formed and measuring a moving velocity of particles by a laser Doppler method.

The surface charge density a ($C/m^2$) of each particle diameter obtained by the measurement is calculated from the charge quantity per particle of the toner. Specifically, the value calculated can be derived by the following equation. $\sigma = Q/\pi D^2$ wherein, Q is charge quantity (C) and D is a toner particle diameter (m).

When the toner satisfies Expression (6), deterioration of transferability and fogging caused by a small particle diameter toner can be suppressed and an excessive increase of the toner charge quantity per unit weight caused by a large particle diameter toner can be suppressed, resulting in good image density stability.

In addition, an absolute value as of an average value of the surface charge density of the second group is preferably 0.038 $C/m^2$ or more and more preferably 0.040 $C/m^2$ or more.

In this case, since the charge quantity of the small particle diameter toner is large, it is possible to make a toner having a small electric field transporting force small, such that transferability is improved and fogging is suppressed.

In addition, an absolute value σl of an average value of the surface charge density of the first group is preferably 0.030 $C/m^2$ or less and more preferably 0.028 $C/m^2$ or less.

In this case, the charge quantity of the large particle diameter toner is not too large. As a result, since the charge quantity per unit weight is not too large, it is possible to improve image density stability.

Further, an absolute value Qs of an average value of the charge quantity per particle of the toner of the second group is preferably 1.4 fC or more. Accordingly, the particles having small charge quantity are decreased, such that transferability may be improved and fogging may be suppressed.

Further, an absolute value Ql of an average value of the charge quantity per particle of the toner of the first group is preferably 2.8 fC or less. Accordingly, the excessive increase in the charge quantity per mass of the toner can be suppressed and image density stability is improved.

An absolute value (Q/M) of the charge quantity per unit mass of the toner is preferably 70 μC/g or less. Accordingly, deterioration of image density may be suppressed.

The charge quantity per unit mass of the toner can be measured, for example, by the following method.

First, under an environment of 23° C. and 50% RH, 0.7 g of a toner and 9.3 g of a carrier (standard carrier designated by Imaging Society of Japan) (N-01) are placed into a 50 mL plastic bottle, the mixture is shaken using a shaker (manufactured by YAYOI Co., Ltd.) at 200 rpm for 5 minutes, and the toner is subjected to triboelectric charge. Subsequently, about 0.15 g of triboelectric charged toner is placed into a metal measuring container having a 635 mesh screen at a bottom thereof and the container is covered by a metal lid. The mass of the entire measuring container at this time is weighed and the weighed mass is W1 (g). Then, with a suction apparatus (at least a part in contact with the measuring container is made of an insulator), suction is performed through a suction port and a pressure of a vacuum gauge is set to be 1.5 kPa by adjusting an air quantity control valve. The suction is sufficiently performed in this state (preferably for 2 minutes) to suck and remove the toner. The charge quantity accumulated in a capacitor at the time is Q (μC). The mass of the entire measuring container after suction is weighed and the weighed mass is W2 (g). The charge quantity per unit weight of the toner (μC/g) is obtained by the following equation.

$$\text{Charge quantity per unit weight of toner } (\mu C/g) = Q/(W1 - W2)$$

<Colorant>

The toner may contain a colorant. A known colorant can be used. A content of the colorant in the toner is preferably 0.1 parts by mass or more and 30.0 parts by mass or less with respect to the total amount of a resin component.

<Binder Resin>

The toner particle in the present disclosure may use the following polymers and the like as a binder resin. The examples thereof include homopolymers of styrene such as polystyrene, poly-p-chlorostyrene, and polyvinyltoluene, and a substituted product thereof; styrene-based copolymers such as a styrene-p-chlorostyrene copolymer, a styrene-vinyltoluene copolymer, a styrene-vinylnaphthalene copolymer, a styrene-acrylic acid ester copolymer, and a styrene-methacrylic acid ester copolymer; polyvinyl chloride; a phenol resin; a natural resin-modified phenol resin; a natural resin-modified maleic acid resin; an acrylic resin; a methacrylic resin; polyvinyl acetate; a silicone resin; polyester; polyurethane; polyamide; a furan resin; an epoxy resin; a xylene resin; polyethylene; polypropylene; and the like. Among them, polyester is preferably used as a main component from the viewpoint of low-temperature fixability.

A polyhydric alcohol (dihydric or trihydric or higher alcohol), a polyvalent carboxylic acid (divalent or trivalent or more carboxylic acid), an acid anhydride thereof, or a lower alkyl ester thereof is used as a monomer for used in polyester. Here, for exhibiting "strain hardening property", it is effective to perform partial crosslinking in a molecule of an amorphous resin in order to produce a branched polymer. To this end, it is preferable to use a trivalent or more polyfunctional compound. Accordingly, as a raw material monomer for polyester, it is preferable to contain a trivalent or more carboxylic acid, an acid anhydride thereof, or a lower alkyl ester thereof, and/or a trihydric or higher alcohol.

As a polyhydric alcohol for used in polyester, the following polyhydric alcohol monomer can be used.

Examples of a dihydric alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and a bisphenol represented by Formula (A) and a derivative thereof; and

[Formula (A)]

(A)

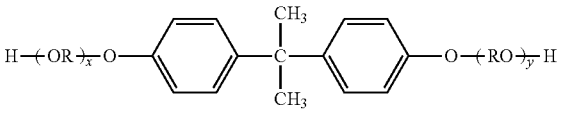

(wherein, R represents an ethylene group or a propylene group, x and y each independently represent an integer of 0 or more, and an average of x+y is 0 or more and 10 or less), diols each represented by Formula (B),

[Formula (B)]

(B)

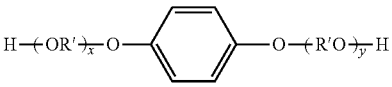

(wherein R' represents —$CH_2CH_2$—, —$CH_2CH(CH_3)$—, or —$CH_2C(CH_3)_2$—, x' and y' each independently represent an integer of 0 or more, and an average of x'+y' is 0 or more and 10 or less).

Examples of a trihydric or higher alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methyl propanetriol, 2-methyl-1,2,4-butanetriol, trimethylolethane, trimethylolpropane, and 1,3,5-trihydroxymethylbenzene. Among them, glycerol, trimethylolpropane, and pentaerythritol are preferably used. These dihydric alcohols and trihydric or higher alcohols can be used alone or in combination.

The following polyvalent carboxylic acid monomers can be used as a polyvalent carboxylic acid monomer for used in polyester.

Examples of divalent carboxylic acid components include a maleic acid, a fumaric acid, a citraconic acid, an itaconic acid, a glutaconic acid, a phthalic acid, an isophthalic acid, a terephthalic acid, a succinic acid, an adipic acid, a sebatic acid, an azelaic acid, a malonic acid, an n-dodecenyl succinic acid, an isododecenyl succinic acid, an n-dodecyl succinic acid, an isododecyl succinic acid, an n-octenyl succinic acid, an n-octyl succinic acid, an isooctenyl succinic acid, an isooctyl succinic acid, and an anhydride of these acids, and a lower alkyl ester thereof. Among them, maleic acid, fumaric acid, terephthalic acid, and n-dodecenyl succinic acid are preferably used.

Examples of trivalent or more carboxylic acid, an acid anhydride thereof or a lower alkyl ester thereof include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxy propane, 1,2,4-cyclohexanetricarboxylic acid, tetra(methylenecarboxyl) methane, 1,2,7,8-octanetetracarboxylic acid, pyromellitic acid, enpol trimer acid, an acid anhydride thereof, or a lower alkyl ester thereof. Among them, in particular, 1,2,4-benzenetricarboxylic acid, that is, trimellitic acid or a derivative thereof is preferably used in terms of low cost and easiness of reaction control. These divalent carboxylic acids and trivalent or more carboxylic acids can be used alone or in combination.

A method for producing polyester is not particularly limited, but a known method can be used. For example, the polyester is produced by simultaneously charging an alcohol monomer and a carboxylic monomer described above and performing polymerization through an esterification reaction or a transesterification reaction, and a condensation reaction. In addition, a polymerization temperature is not particularly limited, but preferably in a range of 180° C. or higher and 290° C. or lower. When polymerizing polyester, it is possible to use, for example, a polymerization catalyst such as a titanium-based catalyst, a tin-based catalyst, zinc acetate, antimony trioxide, or germanium dioxide. In particular, in a case where a binder resin is an amorphous resin, an example of the amorphous resin is more preferably polyester polymerized by using a tin-based catalyst.

In addition, an acid value of the polyester is preferably 5 mgKOH/g or more and 20 mgKOH/g or less, and a hydroxyl value of the polyester is preferably 20 mgKOH/g or more and 70 mgKOH/g or less. Accordingly, since a water adsorption amount can be suppressed and a non-electrostatic adhesive force can be suppressed to be low in high temperature and high humidity environments, fogging can be suppressed.

In addition, the binder resin may be used by mixing a low molecular weight resin and a high molecular weight resin. A content ratio of the high molecular weight resin to the low molecular weight resin is preferably 40/60 to 85/15 on a mass basis from the viewpoint of a low-temperature fixability and a hot-offset resistance.

<Release Agent>

Examples of a wax which is a release agent used in a toner include the following: a hydrocarbon-based wax such as low molecular weight polyethylene, low molecular weight polypropylene, an alkylene copolymer, a microcrystalline wax, a paraffin wax, or a Fischer-Tropsch wax; oxide of a hydrocarbon-based wax such as an oxidized polyethylene wax or a block copolymer thereof; waxes containing a fatty acid ester as a main component, such as a carnauba wax; and a wax obtained by subjecting part or all of fatty acid esters to deoxidization such as a deoxidized carnauba wax. Further, examples the release agent include: saturated linear fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; esters formed of fatty acids such as palmitic acid, stearic acid, behenic acid, and montanic acid, and alcohols such as stearyl alcohol, aralkyl alcohol, behenyl alcohol, carnaubyl alcohol, ceryl alcohol, and melissyl alcohol; fatty acid amides such as linoleic acid amide, oleic acid amide, and lauric acid amide; saturated fatty acid bisamides such as methylenebis stearic acid amide, ethylenebis capric acid amide, ethylenebis lauric acid amide, and hexamethylenebis stearic acid amide; unsaturated fatty acid amides such as ethylenebis oleic acid amide, hexamethylenebis oleic acid amide, N,N'-dioleyl adipic acid amide, and N,N'-dioleyl sebatic acid amide; aromatic bisamides such as m-xylenebis stearic acid amide and N,N'-distearyliso phthalic acid amide; aliphatic metal salts (generally referred to as metal soap) such as calcium stearate, calcium laurate, zinc stearate, and magnesium stearate; waxes obtained by grafting an aliphatic hydrocarbon-based wax with a vinyl-based monomer such as styrene or acrylic acid; a partially esterified product formed of a fatty acid such as behenic acid monoglyceride and a polyhydric alcohol; and a methyl ester compound having a hydroxyl group obtained by subjecting a vegetable oil and fat to hydrogenation.

Among these waxes, a hydrocarbon-based wax such as a paraffin wax and a Fischer-Tropsch wax or a fatty acid ester-based wax such as a carnauba wax is preferable from the viewpoint of improving a low-temperature fixability and fixing and separating ability. In the present disclosure, a hydrocarbon-based wax is more preferable from the viewpoint of more improving a hot-offset resistance.

The wax is preferably used in an amount of 3 parts by mass or more and 8 parts by mass or less per 100 parts by mass of the binder resin.

In addition, in an endothermic curve when heating which is measured by a differential scanning calorimetry (DSC) apparatus, a peak temperature at the maximum endothermic peak of the wax is preferably 45° C. or higher and 140° C. or lower. When the peak temperature at the maximum endothermic peak of the wax is in the above range, both storage ability and hot-offset resistance of the toner can be achieved, which is preferable.

<Inorganic Fine Particle>

The toner may contain inorganic fine particles, if necessary. The inorganic fine particles may be added to a toner base particle or may be mixed with a toner base particle as an external additive.

As an external additive, an inorganic fine particle such as silica, aluminum oxide, titanium oxide, and strontium titanate is preferable, and in particular, as an external additive for improving flowability, an inorganic fine particle having a specific surface area of 50 $m^2/g$ or more and 400 $m^2/g$ or less is preferable. From the viewpoint of suppressing deterioration of charging performance of the external additive in a high humidity environment, it is preferable that the inorganic fine particle is hydrophobized with a hydrophobizing agent such as a silane compound, silicone oil, or a mixture thereof. The toner base particle and the external additive can be mixed with a known mixer such as a Henschel mixer.

<Developer>

The toner can be used as a one-component developer. However, the toner can be mixed with a magnetic carrier and can also be used as a two-component developer in order that dot reproducibility may be further improved and a stable image may be provided for a long period of time.

Examples of the magnetic carrier which can be used include general known magnetic carriers such as iron oxide; metal particles such as iron, lithium, calcium, magnesium, nickel, copper, zinc, cobalt, manganese, chromium, and rare earth, an alloy particle thereof, and an oxide particle thereof; a magnetic body such as ferrite; a magnetic body-dispersed resin carrier (so-called a resin carrier) which contains a magnetic body and a binder resin holding the magnetic body in a dispersed state; and the like.

In a case where the toner is mixed with the magnetic carrier to be used as a two-component developer, a toner concentration in the two-component developer is preferably 2% by mass or more and 15% by mass or less and more preferably 4% by mass or more and 13% by mass or less.

<Method for Producing Toner>

A method for producing toner particles is not particularly limited, but a pulverization method is preferable from the viewpoint of dispersion of a polymer in which a styrene acrylic polymer is subjected to graft polymerization to polyolefin that can be used in the release agent and the binder resin. When the toner particles are produced in an aqueous medium, the release agent with high hydrophobicity or the polymer in which a styrene acrylic polymer is subjected to graft polymerization to polyolefin tends to be localized inside the toner particles. Therefore, it is difficult to form a core-shell structure by a heat treatment apparatus.

Hereinafter, the procedure of toner production in the pulverization method is described.

In a raw material mixing step, each of predetermined amounts of a binder resin, a release agent, a colorant, and crystalline polyester, if necessary, other components, such as a charge control agent, is weighed, formulated, and mixed as materials for constituting toner particles. Examples of a mixing apparatus include a double cone mixer, a V-type mixer, a drum type mixer, a super mixer, a Henschel mixer, a Nauta mixer, and Mechano hybrid (manufactured by NIPPON COKE & ENGINEERING CO., LTD.).

Subsequently, the mixed materials are melt-kneaded to disperse a wax and the like into the binder resin. In the melt-kneading step thereof, a batch type kneader such as a pressure kneader or a Banbury mixer or a continuous kneader can be used. A single-screw or twin-screw extruder is preferably used in terms of superiority of continuous production. Examples of the single-screw or twin-screw extruder include the following: KTK type twin-screw extruder (manufactured by Kobe Steel, Ltd.), TEM type twin-screw extruder (manufactured by TOSHIBA MACHINE CO., LTD.), PCM kneader (manufactured by Ikegai Corp.), Twin-screw extruder (manufactured by TOSEI ENGINEERING), Ko-kneader (manufactured by Buss AG), and Kneadex (manufactured by NIPPON COKE & ENGINEERING CO., LTD.). Further, the resin composition obtained by the melt-kneading may be rolled using a two-roll and may be cooled with water in a cooling step.

Then, the resin composition is pulverized to a desired particle diameter in a pulverizing step. In the pulverizing step, a coarse pulverization is performed using a pulverizer such as a crusher, a hammer mill, or a feather mill. Thereafter, further, a fine pulverization is performed with a fine pulverizer such as Kryptron System (manufactured by Kawasaki Heavy Industries, Ltd.), Super Rotor (manufactured by Nisshin Engineering Inc.), or Turbo Mill (manufactured by FREUND-TURBO CORPORATION) or using an air jet system to obtain toner base particles.

Subsequently, the toner base particles are classified using a classifier or a sieving apparatus, if necessary. Examples of the classifier and the sieving apparatus include the following: an inertial classification type such as Elbow Jet (manufactured by Nittetsu Mining Co., Ltd.) or a centrifugal classification type such as Turboplex (manufactured by Hosokawa Micron Corporation), TSP Separator (manufactured by Hosokawa Micron Corporation), or Faculty (manufactured by Hosokawa Micron Corporation).

Thereafter, a surface treatment of the toner base particles is performed by heating to increase a circularity of the toner. For example, the surface treatment can be performed with hot air using a heat spheroidizing treatment apparatus illustrated in FIGURE.

Hereinafter, the surface treatment using the heat spheroidizing treatment apparatus illustrated in FIG. 1*s* described.

A mixture supplied in a constant amount by a raw material constant amount supply unit 1 is introduced into an introduction pipe 3 by a compressed gas adjusted by a compressed gas adjusting unit 2. The mixture passed through the introduction pipe 3 is uniformly dispersed by a conical protruding member 4 provided so as to be positioned at the central portion of the introduction pipe 3, is introduced into supply pipes 5 radially extending in 8 directions, and is introduced into a treatment chamber 6 where a heat treatment is performed.

At this time, a flow of a mixture supplied to the treatment chamber 6 is regulated by a regulating unit 9 for regulating the flow of the mixture, the regulating unit 9 being provided in the treatment chamber 6. Accordingly, the mixture supplied to the treatment chamber 6 is subjected to the heat treatment while swirling in the treatment chamber 6, and then the mixture is cooled.

Hot air for heat-treating the supplied mixture is supplied from a hot air supply unit 7, is uniformly distributed by a distribution member 12, and is spirally swirled by a swirling member 13 for swirling the hot air toward an outlet 11 of the hot air supply unit to be introduced into the treatment chamber 6. In this configuration, the swirling member 13 for swirling the hot air has a plurality of blades, and the swirl of the hot air can be controlled depending on the number of blades or angles between the blades. The temperature of the hot air to be supplied into the treatment chamber 6 at the outlet of the hot air supply unit 7 is preferably from 100° C. or higher and 300° C. or lower. When the temperature at the outlet of the hot air supply unit 7 falls within the above range, the toner base particles can be uniformly subjected to spheroidizing treatment while the fusion or coalescence of the toner base particles due to excessive heating of the mixture is prevented.

Further, the heat-treated toner base particles subjected to the heat treatment are cooled by cold air supplied from cold air supply units 8 (cold air supply unit 8-1, cold air supply unit 8-2, and cold air supply unit 8-3). The temperature of the cold air supplied from the cold air supply units 8 is preferably −20° C. or higher and 30° C. or lower. When the temperature of the cold air falls within the above range, the heat-treated toner base particles can be efficiently cooled, and the fusion or coalescence of the heat-treated toner base particles can be prevented without the suppression of the uniform spheroidizing treatment for the mixture. An absolute water content of the cold air is preferably 0.5 $g/m^3$ or more and 15.0 $g/m^3$ or less.

Subsequently, the heat-treated toner base particles which are cooled are recovered by a recovery unit 10 positioned at a lower end of the treatment chamber 6. Note that the recovery unit 10 includes a blower (not illustrated) at the tip thereof and the toner base particles are sucked and conveyed by the blower.

In addition, a powder particle supply port 14 is provided so that the swirling direction of the supplied mixture and the swirling direction of the hot air are identical to each other, and the recovery unit 10 of the heat spheroidizing treatment apparatus is provided at an outer peripheral portion of the treatment chamber 6 so that the swirling direction of swirled powder particles is maintained. Further, the cold air supplied from the cold air supply unit 8 is configured to be supplied from the outer peripheral portion of the apparatus to an inner circumferential surface of the treatment chamber from a horizontal and tangential direction. The swirling direction of the toner base particles to be supplied from the powder particle supply port, the swirling direction of the cold air supplied from the cold air supply unit 8, and the swirling direction of the hot air supplied from the hot air supply unit 7 are all identical to one another. Therefore, since no turbulence occurs in the treatment chamber 6, a swirl flow in the apparatus is strengthened, a strong centrifugal force is applied to the toner base particles, and the dispersibility of the toner base particles is additionally improved, toner base particles having a small number of coalesced particles and having a uniform shape can thus be obtained.

When an average circularity of the toner base particles is 0.960 or more and 0.980 or less, the non-electrostatic adhesive force can be suppressed to be low, which is thus preferable from the viewpoint of suppressing fogging.

Thereafter, the toner base particles are divided into a powder particle toner and a coarse particle toner. For example, the dividing is performed using an inertial classification type Elbow Jet (manufactured by Nittetsu Mining Co., Ltd.). Each surface of the divided heat-treated toner base particles is subjected to external treatment of silica fine particles A in a desired amount, thereby obtaining toner particles. An example of the external treatment method includes a method of stirring and mixing by using a mixing apparatus as an external addition machine. Examples of the mixing apparatus which can be used as the external addition apparatus include the following: a double cone mixer, a V-type mixer, a drum type mixer, a super mixer, a Henschel mixer, a Nauta mixer, Mechano hybrid (manufactured by NIPPON COKE & ENGINEERING CO., LTD.), Nobilta (manufactured by Hosokawa Micron Corporation), and the like. At this time, an external additive other than silica fine particles such as a fluidizing agent may be used for external treatment, if necessary.

Hereinafter, methods for measuring various physical properties of a toner and a raw material are described.

<Method for Dividing Toner into First Group and Second Group>

The toner is substantially equally divided into a large particle diameter side and a small particle diameter side on a number basis with an inertial classification type Elbow Jet classifier (manufactured by Nittetsu Mining Co., Ltd.). When a feeding amount and a fine particle classifying edge which are operational conditions of the Elbow Jet are optimized and a coarse particle classifying edge is maximized and closed, the toner is adjusted to be substantially equally divided into a first group and a second group. The setting of the running conditions of the Elbow-Jet starts with adjustment of airflow regulating valves so that an equal amount of airflow is blown to the first group and of the second group. Then, the fine particle classifying edge is adjusted in position to calculate a position at which a difference of approximately 8% is marked between the number of particles sorted into the first group and the number of particles sorted into the second group. Then, the fine particle classifying edge is fixed to the calculated position, and the airflow regulating valves for the first group and the second group are finely tuned to allow the toner particles to be divided substantially equally in half in terms of particle number, into the first group and the second group (difference between particle numbers of these groups is 4% or less). The feed amount set then may be, for example, 5 kg/hr, and a wall closer to passage of fine particles and a tip part of the fine particle classifying edge in the Elbow-Jet may be spaced apart by a distance of, for example, 10 to 15 mm.

<Peak Molecular Weight by GPC of Binder Resin and Weight Average Molecular Weight Measurement>

A molecular weight distribution of a THF-soluble content of a resin may be measured by gel permeation chromatography (GPC) as follows.

First, a toner was dissolved in tetrahydrofuran (THF) at room temperature for over 24 hours. Subsequently, the obtained solution is filtrated with a solvent-resistant membrane filter "Maishori Disk" (manufactured by TOSOH CORPORATION) having a pore diameter of 0.2 μm to obtain a sample solution. Note that the sample solution is adjusted so that a concentration of a component soluble in THF becomes about 0.8% by mass. The measurement is performed by using the sample solution under the following conditions.

Apparatus: HLC8120 GPC (detector: RI) (manufactured by TOSOH CORPORATION)

Column: seven series of Shodex KF-801, 802, 803, 804, 805, 806, and 807 (manufactured by SHOWA DENKO K.K.)

Eluent: tetrahydrofuran (THF)

Flow rate: 1.0 ml/min

Oven temperature: 40.0° C.

Sample injection amount: 0.10 ml

In a calculation of the molecular weight of the sample, a molecular weight calibration curve prepared by using a standard polystyrene resin (for example, trade name "TSK Standard Polystyrene F-850, F-450, F-288, F-128, F-80, F-40, F-20, F-10, F-4, F-2, F-1, A-5000, A-2500, A-1000, and A-500", produced by TOSOH CORPORATION) is used.

<Method for Measuring Softening Point of Binder Resin>

The measurement of a softening point may be performed by using a constant-load extruding capillary rheometer "flow property evaluating apparatus, Flow Tester CFT-500D" (manufactured by Shimadzu Corporation) according to a manual accompanying the apparatus. In this apparatus, the temperature of a measurement sample filled in a cylinder is raised to melt the measurement sample while applying a constant load by a piston from above the measurement sample, and the molten measurement sample is extruded through a die disposed at the bottom of the cylinder, such that a flow curve representing a relationship between the temperature and a descending level of the piston can be obtained.

A "melting temperature in a ½ method" described in the manual accompanying the "flow property evaluating apparatus, Flow Tester CFT-500D" is defined as a softening point. Note that the melting temperature in the ½ method is calculated as described below. First, ½ of a difference between a descending level Smax of the piston at a time when the outflow is finished and a descending level Smin of the piston at a time when the outflow is started is calculated (½ of the difference is defined as X, and X=(Smax−Smin)/2). Then, the temperature in the flow curve when the descending level of the piston reaches X in the flow curve is a melting temperature in the ½ method.

The measurement sample is obtained by subjecting about 1.0 g of a resin to compression molding for about 60 seconds under about 10 MPa by using a tablet molding compressor (for example, NT-100H, manufactured by NPa SYSTEM Co., Ltd.) under an environment of 25° C. to form the measurement sample into a cylindrical shape having a diameter of about 8 mm.

Measurement conditions of the CFT-500D are as follows.

Test mode: temperature rise method

Initial temperature: 50° C.

Reaching temperature: 200° C.

Measurement interval: 1.0° C.

Temperature rise rate: 4.0° C./min

Piston sectional area: 1.000 $cm^2$

Test load (piston load): 10.0 kgf (0.9807 MPa)

Preheating time: 300 seconds

Diameter of hole of die: 1.0 mm

Length of die: 1.0 mm

<Measurement of Glass Transition Temperature (Tg) of Binder Resin>

A glass transition temperature and a melting peak temperature may be measured in accordance with ASTM D3418-82 by using a differential scanning calorimeter "Q2000" (manufactured by TA Instruments Inc.).

For a temperature correction of a detection unit of the apparatus, melting points of indium and zinc are used, and for correction of the quantity of heat, the heat of fusion of indium is used.

Specifically, about 3 mg of the resin or the toner is weighed, the weighed sample is put in an aluminum pan, and the measurement is performed using an empty aluminum pan as a reference under the following conditions.

Temperature rise rate: 10° C./min

Measurement initial temperature: 30° C.

Measurement finish temperature: 180° C.

The measurement is performed in a measurement temperature range of 30° C. to 180° C. at a temperature rise rate of 10° C./min. In the measurement, the temperature is once raised up to 180° C. and maintained for 10 minutes, subsequently lowered to 30° C., and then the temperature is raised again. In this second temperature rising process, a change in specific heat is obtained in a temperature range of 30° C. to 100° C. A point of intersection of a differential thermal curve with a line passing through an intermediate point of a base line before and after occurrence of the change in specific heat at that time is defined as a glass transition temperature (Tg) of the resin.

<Method for Measuring Average Circularity of Toner Particles>

An average circularity of the toner particles may be measured using a flow-type particle image analyzer "FPIA-3000" (manufactured by Sysmex Corporation) under the measurement and analysis conditions at the time of calibration operation.

The measurement principle of the flow-type particle image analyzer "FPIA-3000" (manufactured by Sysmex Corporation) is as follows: a still image of flowing particle is captured, and the captured image is analyzed. A sample added to a sample chamber is transferred to a flat sheath flow cell by a sample suction syringe. The sample transferred to the flat sheath flow cell is formed into a flat flow by being sandwiched between sheath liquids. The sample passing through the flat sheath flow cell is irradiated with stroboscopic light at an interval of 1/60 seconds, and the image of the flowing particles can be captured as the still image. In addition, since the flow is flat, the image is captured in a state in focus. The particle image is captured by a charge-coupled device (CCD) camera and the captured image is subjected to image processing at an image processing resolution of 512×512 pixels (0.37×0.37 μm per pixel), the outline of each particle image is extracted, and a projected area S and a peripheral length L of the particle image are measured.

Then, a circle-equivalent diameter and a circularity are determined using the area S and the peripheral length L described above. The circle-equivalent diameter is a diameter of a circle having the same area as the projected area of the particle image, and a circularity C is defined as a value obtained by dividing the peripheral length of the circle determined from the circle-equivalent diameter by the peripheral length of the projected particle image, and is calculated by the following equation.

$$\text{Circularity } C=2\times(\pi\times S)^{1/2}/L$$

When the particle image is circular, the circularity becomes 1.000, as the degree of peripheral unevenness of the particle image increases, the circularity becomes small. After the circularity of each particle is calculated, an arithmetic average value of the obtained circularity is calculated and the calculated value is defined as an average circularity.

A specific measurement method is as follows.

First, about 20 mL of ion-exchange water from which impure solids are removed in advance is put in a glass vessel. To this, about 0.2 mL of a diluted liquid obtained by diluting about 3 times by mass "Contaminon N" (10% by mass of aqueous solution of pH 7 neutral detergent for cleaning a precise measuring instrument, the aqueous solution being formed of a nonionic surfactant, an anionic surfactant, and an organic builder, manufactured by Wako Pure Chemical Industries, Ltd.) with ion-exchange water is added as a dispersant.

About 0.02 g of the measurement sample is further added and subjected to dispersing treatment with an ultrasonic wave disperser for 2 minutes to prepare a dispersion for measurement. In this case, the temperature of the dispersion is appropriately cooled so as to fall within the range of 10° C. or higher and 40° C. or lower. As the ultrasonic wave disperser, a desktop type ultrasonic cleaner disperser having an oscillation frequency of 50 kHz and an electric output of 150 W (for example, "VS-150" (manufactured by Velvo-Clear)) was used, a predetermined amount of ion-exchange water was put in a water tank, and about 2 mL of the Contaminon N is added to the water tank.

The flow-type particle image analyzer equipped with a standard objective lens (10 magnifications) is used for the measurement, and the particle sheath "PSE-900A" (manufactured by Sysmex Corporation) is used for the sheath liquid. The dispersion prepared according to the above procedure is introduced into the flow-type particle image analyzer and 3,000 toner particles are measured in a high pass filter (HPF) measurement mode and in a total count mode.

It is assumed that a binary threshold at the time of particle analysis is 85% and the analyzed particle diameter is a circle-equivalent diameter of 1.98 m or more and 39.96 m or less, and the average circularity of the toner is calculated.

Prior to the starting of the measurement, automatic focus adjustment is performed using a standard latex particle for the measurement. As the standard latex particle, "RESEARCH AND TEST PARTICLES Latex Microsphere Suspensions 5200A (manufactured by Duke Scientific Corporation)" is used. Then, focus adjustment is performed every 2 hours from the starting of the measurement.

<Method for Measuring Content of Pigment in Toner>

A content of a pigment in the toner may be obtained from a difference in melting properties of the toner constituent material and the pigment in the organic solvent. The binder resin and the release agent are molten in the organic solvent and the pigment is recovered from the toner by filtration to obtain the content of pigment. For example, a polyester resin used for the binder resin or a polymer in which a styrene acrylic polymer is graft-polymerized to polyolefin is soluble in a solvent such as xylene and the like. In addition, a hydrocarbon-based wax can be dissolved in hexane and the like. The pigment such as carbon black or titanium black can be separated due to its non-melting property in these solvents.

In addition, in a case where both carbon black and titanium black are used in a toner, a content of titanium black in the toner isobtained by detecting element Ti with fluorescent X-rays. Then, a content of carbon black is obtained from the content of pigment and the content of titanium black.

Specifically, the following are used as a measuring apparatus. Awavelength dispersion type fluorescent X-ray analyzer "Axios" (manufactured by PANalytical B.V.) and "SuperQ ver.4.0F" (manufactured by PANalytical B.V.) dedicated software accompanying the analyzer for setting measurement conditions and analyzing measurement data are used. Note that Rh is used as an anode for an X-ray tube bulb, and the measurement is performed under conditions of a vacuum atmosphere, a measurement diameter (collimator mask diameter) of 27 mm, and a measurement time of 10 seconds. As a detector, it is possible to use a known detector such as a proportional counter (PC) or a scintillation counter (SC). A pellet obtained by the following procedure is used as a measurement sample: about 4 g of a sample is put into a dedicated aluminum ring for pressing and leveled, and the resultant is pressurized with a tablet molding compressor "BRE-32" (manufactured by Maekawa Testing Machine MFG. Co., LTD.) at 20 MPa for 60 seconds to be molded into the pellet having a thickness of 2 mm and a diameter of 39 mm. A known amount of titanium black is added and mixed to 100 parts by mass of styrene powder with no titanium to produce a pellet for measuring the amount of titanium black. Each of the produced pellets is measured by a fluorescent X-ray analyzer and calibration curves for titanium are constructed based on the peak intensities obtained from the titanium black in the individual samples. Similarly, by measuring the pellets of the toner by the fluorescent X-ray analyzer, a content of titanium black in the toner is calculated by the calibration curves and X-ray intensities of the toner.

(Measurement of Surface Resistivity of Black Pigment-Resin Film)

Xylene: 50 g

Polyethylene: 10 g

Black pigment: 10 g

A resin composition is prepared by mixing the above materials, the mixture is stirred at 110° C. for 2 hours, and then a resin-carbon black film is produced on an aluminum plate using a spin coater to be formed into a thickness of 1 μm, such that a surface resistivity is measured using a resistivity meter in high resistivity range Hiresta-UX MCP-HT800 (manufactured by Mitsubishi Chemical Analytech Co., Ltd.).

According to the present disclosure, a toner excellent in image quality, transferability, and image density stability and suppressing fogging can be provided.

Examples

Hereinafter, the present disclosure will be described in more detail by way of Examples and Comparative Examples. However, the present invention is not limited thereto. It should be noted that a number of parts and % in the Examples and Comparative Examples are in all instances on a mass basis, unless specifically indicated otherwise.

<Production Example of Amorphous Resin 1>

Polyoxypropylene(2.2)-2,2-bis(4-hydroxyphenyl)propane: 73.8 parts by mass (0.19 mol; 100.0 mol % with respect to the total number of moles of polyhydric alcohol)

Terephthalic acid: 12.5 parts by mass (0.08 mol; 48.0 mol % with respect to the total number of moles of polyvalent carboxylic acid)

Adipic acid: 7.8 parts by mass (0.05 mol; 34.0 mol % with respect to the total number of moles of polyvalent carboxylic acid)

Titanium tetrabutoxide (esterification catalyst): 0.5 parts by mass

The materials described above were weighed in a reaction vessel equipped with a cooling pipe, a stirrer, a nitrogen introduction tube, and a thermocouple. Subsequently, the inside of the reaction vessel was substituted with nitrogen gas, the temperature was gradually raised while stirring, and then a reaction was performed for 2 hours while stirring at a temperature of 200° C.

Further, the pressure in the reaction vessel was lowered to 8.3 kPa and maintained for 1 hour. Thereafter, cooling was performed to 160° C. and the pressure returned to atmospheric pressure (first reacting step). Thereafter, the following materials were added.

Trimellitic acid: 5.9 parts by mass (0.03 mol; 18.0 mol % with respect to the total number of moles of polyvalent carboxylic acid)

tert-Butyl catechol (polymerization inhibitor): 0.1 parts by mass

The pressure in the reaction vessel was lowered to 8.3 kPa and the reaction was performed for 15 hours while the temperature was maintained at 200° C. Thereafter, the temperature was lowered and the reaction was stopped after confirming that a softening point measured by ASTM D36-86 reached a temperature of 120° C. (second reacting step) to obtain an amorphous resin 1. The obtained amorphous resin 1 had a peak molecular weight (Mp) of 10,000, a softening point (Tm) of 110° C., and a glass transition temperature (Tg) of 60° C.

<Production Example of Kneaded and Pulverized Product 1>

Amorphous resin 1: 82 parts

Fischer-Tropsch wax (peak temperature of 90° C. at the maximum endothermic peak): 4 parts Polymer in which styrene acrylic polymer is graft-polymerized to polyolefin: 13.5 parts 3,5-Di-t-butylsalicylic acid aluminum compound (Bontron E-88, manufactured by Orient Chemical Industries Co., Ltd.): 0.5 parts Titanium black (product model: 13M-C (manufactured by Mitsubishi Materials Electronic Chemicals Co., Ltd), surface resistivity of $1.1\times10^{13}$ Ω/cm$^2$ when used in resin-black pigment film): 10 parts The above materials were mixed at a rotation speed of 1,500 rpm and for a rotation time of 5 min using a Henschel mixer (FM-75, manufactured by Mitsui Mining Co., Ltd.), and then kneaded in a biaxial kneader (PCM-30, manufactured by Ikegai Corp.) set at a temperature of 130° C. The obtained kneaded product was cooled and coarsely pulverized with a hammer mill to 1 mm or less to obtain a kneaded and pulverized product 1.

<Production Example of Kneaded and Pulverized Product 2>

A kneaded and pulverized product 2 was obtained in the same manner as the kneaded and pulverized product 1, except that 8 parts of titanium black and 2 parts of carbon black (#4400 (manufactured by Tokai Carbon Co., Ltd.), surface resistivity of $2.3\times10^{8}$ Ω/cm$^2$ when used in resin-black pigment film) were used instead of 10 parts of titanium black.

Note that all titanium black and carbon black to be used in the following Production Examples are as follows.

Titanium black (product model: 13M-C (manufactured by Mitsubishi Materials Electronic Chemicals Co., Ltd), surface resistivity of $1.1\times10^{13}$ Ω/cm$^2$ when used in resin-black pigment film)

Carbon black (#4400 (manufactured by Tokai Carbon Co., Ltd.), surface resistivity of $2.3\times10^{8}$ Ω/cm$^2$ when used in resin-black pigment film)

<Production Example of Kneaded and Pulverized Product 3>

A kneaded and pulverized product 3 was obtained in the same manner as the kneaded and pulverized product 1, except that 5 parts of titanium black and 5 parts of carbon black were used instead of 10 parts of titanium black.

<Production Example of Kneaded and Pulverized Product 4>

A kneaded and pulverized product 4 was obtained in the same manner as the kneaded and pulverized product 1, except that 2 parts of titanium black and 8 parts of carbon black were used instead of 10 parts of titanium black.

<Production Example of Kneaded and Pulverized Product 5>

A kneaded and pulverized product 5 was obtained in the same manner as the kneaded and pulverized product 1, except that 10 parts of carbon black was used instead of 10 parts of titanium black.

<Production Example of Kneaded and Pulverized Product 6>

A kneaded and pulverized product 6 was obtained in the same manner as the kneaded and pulverized product 1, except that 10 parts of titanium black and 2 parts of carbon black were used instead of 10 parts of titanium black, and 80 parts of the amorphous resin 1 was used.

<Production Example of Kneaded and Pulverized Product 7>

A kneaded and pulverized product 7 was obtained in the same manner as the kneaded and pulverized product 1, except that 7 parts of titanium black was used instead of 10 parts of titanium black, and 85 parts of the amorphous resin 1 was used.

<Production Example of Kneaded and Pulverized Product 8>

A kneaded and pulverized product 8 was obtained in the same manner as the kneaded and pulverized product 1, except that 7 parts of carbon black was used instead of 10 parts of titanium black, and 85 parts of the amorphous resin 1 was used.

<Production Example of Kneaded and Pulverized Product 9>

A kneaded and pulverized product 9 was obtained in the same manner as the kneaded and pulverized product 1, except that 15 parts of titanium black was used instead of 10 parts of titanium black, and 77 parts of the amorphous resin 1 was used.

<Production Example of Kneaded and Pulverized Product 10>

A kneaded and pulverized product 10 was obtained in the same manner as the kneaded and pulverized product 1, except that 5 parts of titanium black and 15 parts of carbon black were used instead of 10 parts of titanium black, and 77 parts of the amorphous resin 1 was used.

<Production Examples of F Toner and M Toner>

The kneaded and pulverized product 1 was subjected to fine pulverization under an operational condition of a rotor rotation speed of 12,000 rpm using a mechanical pulverizer (T-250, manufactured by FREUND-TURBO CORPORATION). In addition, the kneaded and pulverized product was subjected to classification using Faculty F-300 (manufactured by Hosokawa Micron Corporation) under the operational conditions of a classification rotor rotation speed of 9,000 rpm and a dispersion rotor rotation speed of 7,200 rpm, thereby obtaining an F toner 1 (a second group).

The kneaded and pulverized product 1 was subjected to pulverizing classification in the same manner as the F toner 1, except that for the operational condition of the mechanical pulverizer, a rotor rotation speed was set to 10,000 rpm, and for the operational condition of the Faculty, the classification rotor rotation speed was set to 8,000 rpm, thereby obtaining an M toner 1 (a first group). The kneaded and pulverized products 2 to 10 were also subjected to pulverizing classification in the same manner to obtain F toners 2 to 10 and M toners 2 to 10, respectively.

<Production Example of Toner 1>

50 parts of the F toner 1 and 50 parts of the M toner 5 were mixed and heat treatment was performed by the heat spheroidizing treatment apparatus illustrated in FIGURE, thereby obtaining a heat-treated toner 1. For the operational conditions, the feeding amount was 5 kg/hr, the hot air temperature C was 160° C., the hot air flow rate was 6 $m^3$/min, the cold air temperature E was −5° C., the cold air flow rate was 4 $m^3$/min, the blower air volume was 20 $m^3$/min, and the injection air flow rate was 1 $m^3$/min.

100 parts of the heat-treated toner 1 was mixed with 4.0 parts of sol-gel silica (median diameter (D50) of 40 nm on a number basis) subjected to surface treatment with hexamethyl disilazane as a silica fine particle A. Thereafter, the mixture was mixed using a Henschel mixer (FM-75, manufactured by Mitsui Mining Co., Ltd.), under the conditions of the rotation speed of 1,900 rpm and a rotation time of 10 min, thereby obtaining a toner 1.

The toner 1 was equally divided into a large particle diameter side and a small particle diameter side on a number basis with an inertial classification type Elbow Jet (manufactured by Nittetsu Mining Co., Ltd.) and used for each evaluation. The operational condition of the Elbow Jet was adjusted so that the feeding amount was 5 kg/hr, the fine particle classifying edge was 10 to 15 mm, a coarse particle classifying edge was maximized and closed, and the toner 1 was equally divided into a first group and a second group.

A median diameter (D50) of the toner 1 on a number basis was 4.5 jam, a span value of the toner 1 was 0.80, and an average circularity of the toner 1 was 0.968.

The evaluation results of the absolute values σs and σl of the average value of the surface charge density and the absolute values Qs and Ql of the average value of the charge quantity, the charge quantity per unit mass of the toner (Q/M), the surface potential change rates As and Al, and black pigment contents bkh, BKH, bkl, and BKL of the toner 1 are shown in Table 1.

<Production Examples of Toners 2 to 16>

Toners 2 to 6 and comparative toners 1 to 7 were obtained in the same manner as in the production example of the toner 1, except that the combination of the F toner and the M toner was changed as shown in Table 1.

Respective evaluation results of the toners 2 to 6 and the comparative toners 1 to 7 are shown in Table 1.

TABLE 1

| | F Toner | M Toner | Average Particle diameter (μm) | Span | Average Circularity | As (%) | Al (%) | Al/As | bkh (wt %) | bkl (wt %) | BKH (wt %) |
|---|---|---|---|---|---|---|---|---|---|---|---|
| Toner 1 | 1 | 5 | 4.5 | 0.80 | 0.968 | 30.0 | 65.0 | 2.2 | 7.9 | 2.0 | 2.1 |
| Toner 2 | 2 | 4 | 4.6 | 0.78 | 0.967 | 37.0 | 58.0 | 1.6 | 6.8 | 3.2 | 3.2 |
| Toner 3 | 1 | 4 | 4.6 | 0.79 | 0.968 | 27.7 | 55.7 | 2.0 | 8.4 | 1.6 | 3.6 |
| Toner 4 | 2 | 5 | 4.6 | 0.81 | 0.966 | 39.3 | 67.3 | 1.7 | 6.4 | 3.6 | 1.6 |
| Toner 5 | 7 | 5 | 4.5 | 0.82 | 0.967 | 28.0 | 64.5 | 2.3 | 5.6 | 2.0 | 1.4 |
| Toner 6 | 6 | 5 | 4.5 | 0.82 | 0.967 | 40.7 | 67.7 | 1.7 | 8.0 | 3.6 | 2.0 |
| Comparative Toner 1 | 5 | 5 | 4.5 | 0.80 | 0.968 | 76.7 | 76.7 | 1.0 | 0.0 | 10.0 | 0.0 |
| Comparative Toner 2 | 1 | 1 | 4.5 | 0.81 | 0.968 | 18.3 | 18.3 | 1.0 | 10.0 | 0.0 | 10.0 |
| Comparative Toner 3 | 5 | 1 | 4.5 | 0.78 | 0.966 | 65.0 | 30.0 | 0.5 | 2.0 | 8.0 | 8.0 |
| Comparative Toner 4 | 3 | 3 | 4.6 | 0.77 | 0.967 | 47.5 | 47.5 | 1.0 | 5.0 | 5.0 | 5.0 |
| Comparative Toner 5 | 4 | 2 | 4.5 | 0.80 | 0.967 | 58.0 | 37.0 | 0.6 | 3.2 | 6.8 | 6.8 |
| Comparative Toner 6 | 6 | 8 | 4.6 | 0.81 | 0.968 | 36.7 | 51.7 | 1.4 | 8.0 | 3.0 | 2.0 |
| Comparative Toner 7 | 9 | 10 | 4.5 | 0.82 | 0.968 | 27.7 | 69.8 | 2.52 | 13 | 2 | 7 |

| | BKL (wt %) | σs ($C/m^2$) | σl ($C/m^2$) | σl/σs | Qs (fC) | Ql (fC) | Q/M (μC/g) | bkl/bkh | BKH/BKL | (bkl + bkh)/(BKH + BKL) |
|---|---|---|---|---|---|---|---|---|---|---|
| Toner 1 | 8.0 | 0.045 | 0.028 | 0.61 | 1.8 | 2.1 | 35.7 | 0.25 | 0.25 | 1.0 |
| Toner 2 | 6.8 | 0.042 | 0.031 | 0.75 | 1.7 | 2.4 | 39.5 | 0.47 | 0.47 | 1.0 |
| Toner 3 | 6.4 | 0.046 | 0.032 | 0.70 | 1.8 | 2.5 | 41.1 | 0.19 | 0.56 | 1.0 |
| Toner 4 | 8.4 | 0.040 | 0.026 | 0.65 | 1.6 | 2.1 | 33.9 | 0.56 | 0.19 | 1.0 |
| Toner 5 | 8.0 | 0.046 | 0.028 | 0.60 | 1.8 | 2.2 | 36.2 | 0.36 | 0.18 | 0.8 |
| Toner 6 | 8.4 | 0.040 | 0.026 | 0.66 | 1.6 | 2.0 | 33.0 | 0.45 | 0.24 | 1.1 |
| Comparative Toner 1 | 10.0 | 0.022 | 0.022 | 1.00 | 0.9 | 1.7 | 22.0 | — | 0.00 | 1.0 |
| Comparative Toner 2 | 0.0 | 0.051 | 0.051 | 1.00 | 2.0 | 4.0 | 72.1 | 0.00 | — | 1.0 |
| Comparative Toner 3 | 2.0 | 0.028 | 0.045 | 1.64 | 1.1 | 3.5 | 56.2 | 4.00 | 4.00 | 1.0 |
| Comparative Toner 4 | 5.0 | 0.036 | 0.036 | 1.00 | 1.5 | 2.8 | 42.3 | 1.00 | 1.00 | 1.0 |
| Comparative Toner 5 | 3.2 | 0.031 | 0.042 | 1.34 | 1.2 | 3.2 | 51.0 | 2.13 | 2.13 | 1.0 |
| Comparative Toner 6 | 6.0 | 0.042 | 0.034 | 0.82 | 1.7 | 2.7 | 43.0 | 0.38 | 0.33 | 1.4 |
| Comparative Toner 7 | 8 | 0.038 | 0.029 | 0.76 | 1.4 | 2.2 | 23.5 | 0.15 | 0.88 | 1.0 |

<Preparation Example of Magnetic Core Particle 1>

Step 1 (Weighing and Mixing Step)

$Fe_2O_3$: 62.7 Parts $MnCO_3$: 29.5 Parts $Mg(OH)_2$: 6.8 Parts $SrCO_3$: 1.0 Part The above materials were weighed so that the materials had the above composition ratio. Thereafter, the mixture was pulverized and mixed for 5 hours with a dry vibration mill using stainless steel beads having a diameter of ⅛ inch.

Step 2 (Prefiring Step)

The obtained pulverized product was prepared as a pellet having a size of about 1 mm square using a roller compactor. Coarse particles were removed from the pellet using a vibrating sieve having an opening size of 3 mm, and then fine particles were removed using a vibrating sieve having an opening size of 0.5 mm. Thereafter, the product was fired under a nitrogen atmosphere (oxygen concentration: 0.01% by volume) using a burner type firing furnace at a temperature of 1,000° C. for 4 hours to produce a pre-fired ferrite. The composition of the obtained pre-fired ferrite is as follows.

$$(MnO)_a(MgO)_b(SrO)_c(Fe_2O_3)_d$$

In Formula, a=0.257, b=0.117, c=0.007, and d=0.393.

Step 3 (Pulverizing Step)

The obtained pre-fired ferrite was pulverized to a size of about 0.3 mm with a crusher, 30 parts of water was added to 100 parts of the pre-fired ferrite, and the pre-fired ferrite was then pulverized for 1 hour with a wet ball mill using zirconia beads having diameters of ⅛ inch. The obtained slurry was pulverized for 4 hours with a wet ball mill using alumina beads having diameters of 1/16 inch to obtain ferrite slurry (finely pulverized product of pre-fired ferrite).

Step 4 (Granulating Step)

To the ferrite slurry, 1.0 part of ammonium polycarboxylate as a dispersant and 2.0 parts of polyvinyl alcohol as a binder, each with respect to 100 parts of the pre-fired ferrite, were added, and the mixture was then granulated into spherical particles using a spray dryer (manufactured by Ohkawara Kakohki Co., Ltd.). After adjusting the particle diameters of the obtained particles, the particles were heated at 650° C. for 2 hours using a rotary kiln to remove organic components such as the dispersant and the binder.

Step 5 (Firing Step)

In order to control the firing atmosphere, the temperature was raised from room temperature to 1,300° C. for 2 hours under a nitrogen atmosphere (oxygen concentration: 1.00% by volume) using an electric furnace, and then the firing temperature was maintained at 1,150° C. for 4 hours to fire the spherical particles obtained in Step 4. Thereafter, the temperature was lowered to 60° C. over 4 hours, the nitrogen atmosphere was allowed to return to the atmosphere, and the particles were taken out at a temperature of 40° C. or lower.

Step 6 (Sorting Step) After crushing the aggregated spherical particles, particles having a low magnetic force were selectively removed by magnetic separation, and coarse particles were removed by sieving with a sieve having an opening size of 250 μm to obtain a magnetic core particle 1 having a 50% particle diameter of 37.0 μm on a volume distribution basis.

<Preparation of Coating Resin 1>

Cyclohexyl methacrylate: 26.8% by mass

Methyl methacrylate: 0.2% by mass

Methyl methacrylate macromonomer (macromonomer having a methacryloyl group at one terminal and a weight average molecular weight of 5,000): 8.4% by mass Toluene: 31.3% by mass Methyl ethyl ketone: 31.3% by mass The above materials were placed in a four-necked separable flask equipped with a reflux condenser, a thermometer, a nitrogen introduction tube, and a stirrer, and nitrogen gas was introduced to obtain sufficient nitrogen atmosphere. Thereafter, the temperature was raised to 80° C., 2.0% by mass of azobisisobutyronitrile was added, and the mixture was refluxed for 5 hours to polymerize. Hexane was added to the obtained reaction product, the copolymer was precipitated, the precipitate was filtered, and then the precipitate was subjected to vacuum dry to obtain a coating resin 1. Subsequently, 30 parts of the coating resin 1 was dissolved in 40 parts of toluene and 30 parts of methyl ethyl ketone to obtain a polymer solution 1 (solid content: 30% by mass).

<Preparation of Coating Resin Solution 1>

Polymer Solution 1 (resin solid content concentration: 30%): 33.3% by mass

Toluene: 66.4% by mass

Carbon black Regal 330 (manufactured by Cabot Corporation, primary particle diameter of 25 nm, nitrogen adsorption specific surface area of 94 $m^2/g$, DBP oil absorption amount of 75 mL/100 g): 0.3% by mass The above materials were mixed for 1 hour with a paint shaker using zirconia beads having a diameter of 0.5 mm and carbon black was dispersed in a medium. The obtained dispersion was filtered through a 5.0 μm membrane filter to obtain a coating resin solution 1.

<Production Example of Magnetic Carrier 1>

(Resin Coating Step)

To a vacuum degassed kneader maintained at room temperature, the magnetic core particle 1 and the coating resin solution 1 were charged (the amount of coating resin solution was charged as a resin component in an amount of 2.5 parts with respect to 100 parts of the magnetic core particle 1). After the charging, the mixture was stirred at a rotation speed of 30 rpm for 15 minutes, the solvent was volatilized to a predetermined level (80% by mass) or more, the temperature was raised to 80° C. while mixing the product under reduced pressure, toluene was distilled over 2 hours, and then the mixture was cooled. From the obtained magnetic carrier, the low magnetic force product was separated by magnetic separation, and passed through a sieve having an opening of 70 jam, and classified with a wind power classifier to obtain a magnetic carrier 1 having a 50% particle size (D50) of 38.2 μm on a volume basis.

<Production Example of Two-Component Developer>

8.0 parts of the toner 1 and 92.0 parts of the magnetic carrier 1 were mixed by a V type mixer (V-20, manufactured by SEISHIN ENTERPRISE Co., Ltd.) to obtain a two-component developer 1. Similarly, each of the toners 2 to 6 and comparative toners 1 to 7 was mixed with the magnetic carrier 1 to obtain two-component developers 2 to 6 and comparative two-component developers 1 to 7.

<Evaluation of Developer>

The evaluations described below were conducted by using the obtained two-component developer.

As an image forming apparatus, a remodeled version of commercial digital printing printer image RUNNER ADVANCE C5560 (manufactured by Canon Inc.) was used.

Remodeling of the apparatus was performed so that a fixation temperature, a process speed, a direct current voltage $V_{DC}$ of a developer carrier, a charging voltage $V_D$ of an electrostatic latent image-bearing member, and laser power could be freely set. An FFh image (a solid image) was output and $V_{DC}$, $V_D$, and laser power were adjusted so that the amount of residual toner of the FFh image becomes 35 $mg/cm^2$ to conduct an image output evaluation described below. FFh is a value representing 256 gradations by a hexadecimal number, 00h is the first gradation of 256 gradations (white background portion), and FFh is the $256^{th}$ gradation of 256 gradations (solid portion).

[Suppression of Fogging]

The two-component developer was placed into a black developing unit of the image forming apparatus and the evaluation image was output to conduct the evaluation of suppression of fogging under the following conditions.

Paper: CS-680 (68.0 g/$m^2$) (manufactured by Canon Marketing Japan Inc.)

Evaluation image: 00h image over entire surface of the above-described A4 paper

Vback: 150 V (adjusted by direct current voltage $V_{DC}$ of developer carrier, charging voltage $V_D$ of electrostatic latent image-bearing member, and laser power)

Test environment: high temperature and high humidity environment (temperature of 30° C./humidity of 80% RH)

Fixing temperature: 170° C.

Process speed: 377 mm/sec

A fogging value defined below was used as the evaluation index of suppression of fogging.

First, the average reflectance Ds (%) of the evaluation paper before paper feeding was measured using a reflectometer (REFLECTOMETER MODEL TC-6DS: manufactured by Tokyo Denshoku Co., LTD.). Next, the average reflectance Dr (%) of the evaluation paper after paper feeding was measured. Then, the fogging value was calculated using the following equation. The obtained fogging value was evaluated according to the following evaluation criteria.

$$\text{Fogging value}=Dr(\%)-Ds(\%)$$

(Evaluation Criteria)

A: Fogging value is less than 0.3% (excellent)

B: Fogging value is 0.3% or more and less than 0.5% (good)

C: Fogging value is 0.5% or more and less than 0.8% (level with no problem)

D: Fogging value is 0.8% or more (unacceptable)

[Transferability]

The two-component developer was placed in a cyan developing unit of the image forming apparatus and transferability was evaluated under the following conditions.

Paper: GF-C081 (81.0 g/$m^2$) (manufactured by Canon Marketing Japan)

Amount of residual toner in solid image: 0.35 mg/$cm^2$

Primary transfer current: 30 μA

Test environment: normal temperature and normal humidity environment (temperature 23° C./humidity 50% RH)

Process speed: 377 mm/sec

The residual toner on a photosensitive drum after the primary transfer and the toner before the primary transfer were peeled off by taping with a transparent adhesive tape formed of polyester. The peeled adhesive tape was stuck onto the paper and a density thereof was measured with a spectral densitometer 500 series (manufactured by X-Rite, Incorporated).

The image density before the primary transfer and the change rate of the image density of the transfer residue thus obtained were used as transfer efficiency, and the evaluation was conducted based on the following evaluation criteria.

A: Transfer efficiency is 90% or more

B: Transfer efficiency is 85% or more and less than 90%

C: Transfer efficiency is 80% or more and less than 85%

D: Transfer efficiency is less than 80%

[Image Density Stability]

The two-component developer was placed in a cyan developing unit of the image forming apparatus and the evaluation image was output to conduct the evaluation of image density stability under the following conditions.

Paper: GFC-081 (81.0 g/$m^2$) (manufactured by Canon Marketing Japan Inc.)

Vcontrast (adjusted by direct current voltage $V_{DC}$ of developer carrier, charging voltage $V_D$ of electrostatic latent image-bearing member, and laser power): 350 V Evaluation image: 2 cm×5 cm of image disposed at the center of the above-described A4 paper Test environment: normal temperature and normal humidity environment (temperature 23° C./humidity 50% RH)

Fixing temperature: 170° C.

Process speed: 377 mm/sec

An image density value was used as an evaluation index. The image density of the central portion of the paper was measured using an X-Rite color reflection densitometer (500 series: manufactured by X-Rite, Incorporated). The obtained image density value was evaluated according to the following evaluation criteria.

(Evaluation Criteria)

A: Image density value is 1.35 or more (excellent)

B: Image density value is 1.30 or more and less than 1.35 (good)

C: Image density value is 1.25 or more and less than 1.30 (level with no problem)

D: Image density value is less than 1.25 (unacceptable)

[Image Quality]

The two-component developer was placed in a cyan developing unit of the image forming apparatus and the evaluation image was output to conduct the evaluation of image quality under the following conditions.

Paper: GFC-081 (81.0 g/$m^2$) (manufactured by Canon Marketing Japan Inc.) Vcontrast (adjusted by direct current voltage $V_{DC}$ of developer carrier, charging voltage $V_D$ of electrostatic latent image-bearing member, and laser power): 300 V Evaluation image: longitudinal line image with 1 dot and 1 space disposed on the above-described A4 paper Test environment: normal temperature and normal humidity environment (temperature 23° C./humidity 50% RH) (hereinafter, "N/N")

Fixing temperature: 170° C.

Process speed: 377 mm/sec

A blur value (a numerical value representative of the way of blurring of a line defined by ISO 13660) was used as an evaluation index of image quality. The blur value was measured using a personal image analysis system (IAS) (manufactured by Quality Engineering Associates (QEA) Inc.). The obtained blur value was evaluated according to the following evaluation criteria.

(Evaluation Criteria)

A: Blur value is less than 35 μm (excellent)

B: Blur value is 35 μm or more and less than 38 μm (good)

C: Blur value is 38 μm or more and less than 41 μm (level with no problem)

D: Blur value is 41 μm or more (unacceptable)

For the two-component developers 2 to 6 and the comparative two-component developers 1 to 7, suppression of fogging, transferability, image density stability, and image quality were evaluated in the same manner as the two-component developer 1. The evaluation results are summarized in Table 2.

TABLE 2

| | Suppression of fogging | Transferability | Image density stability | Image quality |
|---|---|---|---|---|
| Two-component developer 1 | A | A | A | A |
| Two-component developer 2 | A | A | B | A |
| Two-component developer 3 | A | A | C | A |
| Two-component developer 4 | C | B | A | A |
| Two-component developer 5 | C | C | A | B |
| Two-component developer 6 | C | B | B | B |
| Comparative two-component developer 1 | C | D | B | B |
| Comparative two-component developer 2 | A | A | D | D |
| Comparative two-component developer 3 | C | C | D | C |
| Comparative two-component developer 4 | D | C | C | C |
| Comparative two-component developer 5 | D | D | C | C |
| Comparative two-component developer 6 | B | A | C | D |
| Comparative two-component developer 7 | D | C | A | A |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-152731, filed Aug. 14, 2018, and Japanese Patent Application No. 2019-128587, filed Jul. 10, 2019, which are hereby incorporated by reference herein in their entirety.

What is claimed is:

1. A toner comprising toner particles, wherein the toner particles contain a binder resin and a pigment, and when the toner is divided into two groups, a first group and a second group with an inertial classifier, the first group including a larger size of the toner particles, and the second group including a smaller size of the toner particles, and the number of the toner particles in the first group being substantially equal to the number of the toner particles in the second group, Al and As satisfy the following Expression (1), $$1.5 \leq Al/As \leq 2.5 \quad (1)$$

wherein Al represents a change rate (%) of a surface potential of a pellet type molded product Pl made of the toner in the first group as measured by a following procedure:

measurement of Al:

molding 0.05 g of the toner in the first group under conditions of 20 kN to form the pellet type molded product Pl having a diameter of 10 mm;

charging a surface of the pellet type molded product Pl to −600 V by a scorotron charger;

after the charging, measuring a surface potential of the pellet type molded product Pl to obtain an initial surface potential;

after the obtaining of the initial surface potential, leaving the pellet type molded product Pl under conditions of a temperature of 25° C. and a humidity of 50% for 1 hour;

after the leaving, measuring the surface potential of the pellet type molded product Pl and calculating a changing rate of the surface potential with respect to the initial surface potential as the change rate (%), and As represents a change rate (%) of a surface potential of a pellet type molded product Ps made of the toner in the second group as measured by a following procedure:

measurement of As:

molding 0.05 g of the toner in the second group under conditions of 20 kN to form the pellet type molded product Ps having a diameter of 10 mm;

charging a surface of the pellet type molded product Ps to −600 V by a scorotron charger;

after the charging, measuring a surface potential of the pellet type molded product Ps to obtain an initial surface potential;

after the obtaining of the initial surface potential, leaving the pellet type molded product Ps under conditions of a temperature of 25° C. and a humidity of 50% for 1 hour;

after the leaving, measuring the surface potential of the pellet type molded product Ps and calculating a changing rate of the surface potential with respect to the initial surface potential as the change rate (%).

2. The toner according to claim 1, wherein the toner particles contain a high-resistance black pigment and a low-resistance black pigment, a surface resistivity of a polyethylene-black pigment film formed by using a resin composition obtained by dispersing 50 parts by mass of the high-resistance black pigment in 50 parts by mass of polyethylene is $1\times10^{13}$ $\Omega/cm^2$ or more, a surface resistivity of a polyethylene-black pigment film formed by using a resin composition obtained by dispersing 50 parts by mass of the low-resistance black pigment in 50 parts by mass of polyethylene is $1\times10^{11}$ $\Omega/cm^2$ or less, and bkh, bkl, BKH, BKL satisfy the following Expression (2) to (4)

$$bkl/bkh \leq 0.5 \quad (2),$$

$$BKH/BKL \leq 0.5 \quad (3), \text{ and}$$

$$0.9 \leq (bkl+bkh)/(BKH+BKL) \leq 1.1 \quad (4),$$

in which BKH is a content of the high-resistance black pigment and BKL is a content of the low-resistance black pigment in the first group, and bkh is a content of the high-resistance black pigment and bkl is a content of the low-resistance black pigment in the second group.

3. The toner according to claim 2, wherein the low-resistance black pigment is carbon black.

4. The toner according to claim 2, wherein the high-resistance black pigment is titanium oxynitride.

5. The toner according to claim 1, wherein a median diameter D50 of the toner on a number basis is 3.0 μm or more and 6.0 μm or less, and a span value of the toner obtained by the following Equation (5) is 0.7 or more and 2.0 or less, $$\text{Span value} = (D90 - D10)/D50 \quad (5)$$

wherein D90 is a cumulative 90% particle diameter on a number basis and D10 is a cumulative 10% particle diameter on a number basis.

* * * * *